United States Patent [19]

Parker, Jr.

[11] Patent Number: 4,723,537

[45] Date of Patent: Feb. 9, 1988

[54] PASSIVE EXERCISING APPARATUS

[76] Inventor: Alonzo E. Parker, Jr., P.O. Box 11276, Durham, N.C. 27703

[21] Appl. No.: 943,715

[22] Filed: Dec. 19, 1986

[51] Int. Cl.[4] ..... A61H 1/02

[52] U.S. Cl. ..... 128/25 R; 128/70

[58] Field of Search ..... 128/25 R, 25 B, 70, 128/71, 72, 73, 74, 45, 46, 52; 272/130

[56] References Cited

U.S. PATENT DOCUMENTS

| | | | |
|---|---|---|---|
| 1,448,477 | 3/1923 | Williams | 128/72 |
| 1,602,196 | 10/1926 | Iverson et al. | 128/25 R X |
| 1,686,979 | 10/1928 | McManis | 128/25 R |
| 2,494,746 | 1/1950 | Colston | 128/25 R X |
| 2,598,204 | 5/1952 | Allen | 128/25 R |
| 2,666,429 | 1/1954 | Alexander et al. | 128/52 X |
| 2,949,911 | 8/1960 | Kennard et al. | 128/25 R |
| 3,472,222 | 10/1969 | Aplin | 128/25 R |
| 3,628,528 | 12/1971 | Roberts | 128/25 R X |
| 3,674,017 | 7/1972 | Stefani, Jr. | 128/25 R |
| 3,735,754 | 5/1973 | Reed | 128/25 R |
| 3,771,518 | 11/1973 | Greissing | 128/71 |

*Primary Examiner*—Richard J. Apley
*Assistant Examiner*—David J. Bender
*Attorney, Agent, or Firm*—B. B. Olive

[57] ABSTRACT

A passive exercising apparatus comprising a first stationary horizontal platform connected to a second platform forming a lengthwise extension of the first platform and connected thereto for relatively pivotal or rotative movement. A drive mechanism is supported below the second platform and includes adjustable linkages enabling the second platform to be selectively pivoted up and down or back and forth around its central longitudinal axis so as to vary the type of exercise obtained.

5 Claims, 7 Drawing Figures

PASSIVE EXERCISING APPARATUS

TECHNICAL FIELD

The invention relates broadly to exercising apparatus and more specifically to passive exercising apparatus of the type in which selected portions of a person's body are moved relative to other portions while the body rests on platforms that move relative to each other.

BACKGROUND ART

U.S. Pat. No. 3,674,017 teaches a passive exercising apparatus which moves the torso with respect to the legs or from a prone to a sitting position. The apparatus of the patent incorporates a first stationary table and a second table which pivots relative to the first. While such an apparatus is useful for invalids as well as overweight persons desiring to lose weight, it does not allow the body to be twisted or to be simultaneously twisted and pivoted to enhance exercising of stomach and back muscles. Also, the apparatus disclosed in this patent is not able to pivot any portion of the body below a horizontal plane. While the passive exercising apparatus of U.S. Pat. No. 2,598,204 allows portions of the body to be pivoted below a horizontal plane, such apparatus does not provide for twisting of the body or for simultaneously twisting and pivoting. U.S. Pat. No. 2,494,746 also teaches a passive exercising apparatus which imparts vertical and horizontal reciprocating as well as circular motion to a table. However, this last mentioned apparatus cannot be adjusted so as to selectively deliver either a pivoting or twisting motion, or both pivoting and twisting motions simultaneously. U.S. Pat. No. 3,472,222 teaches twisting the head only but otherwise lacks the ability to pivot or twist major portions of the body. U.S. Pat. No. 3,735,754 teaches use of four reciprocating platforms but with no ability to pivot or twist the body.

While other prior art might be described, the foregoing is believed to be sufficiently representative of the state of the art and a need for a further improved passive exercising apparatus meeting the described deficiencies of the prior passive exercising machines. The provision of such an improved passive exercise machine thus becomes a primary object of the invention. Other objects will become apparent as the description proceeds.

DISCLOSURE OF THE INVENTION

The apparatus of the invention incorporates a fixed table supported on a frame and a movable table supported on adjustable length linkages operated by either one or the other of two sets of crank arms of different length. One set of crank arms is 180° out of phase with the other set. The crank arms are driven through a motor drive mounted on a frame which can be rotated 90° to bring the two sets of crank arms into either of two modes of operation. The fixed table connects to and supports the movable table through a connection which can both pivot and rotate. One mode of operation enables the movable table to be pivoted about a fixed longitudinal central axis and in a relatively high or relatively low pivoting motion dependent on how the linkages are connected. In another mode of operation, the linkages can be connected so as to either pivot the movable platform around a fixed horizontal axis at one end of the fixed platform or pivot the movable platform around a central longitudinal axis to twist the body or simultaneously pivot and twist the selected portion of the body.

Combined foot rest and hand holds provide variations on the described exercises.

BEST MODE FOR CARRYING OUT THE INVENTION

Figure 1:
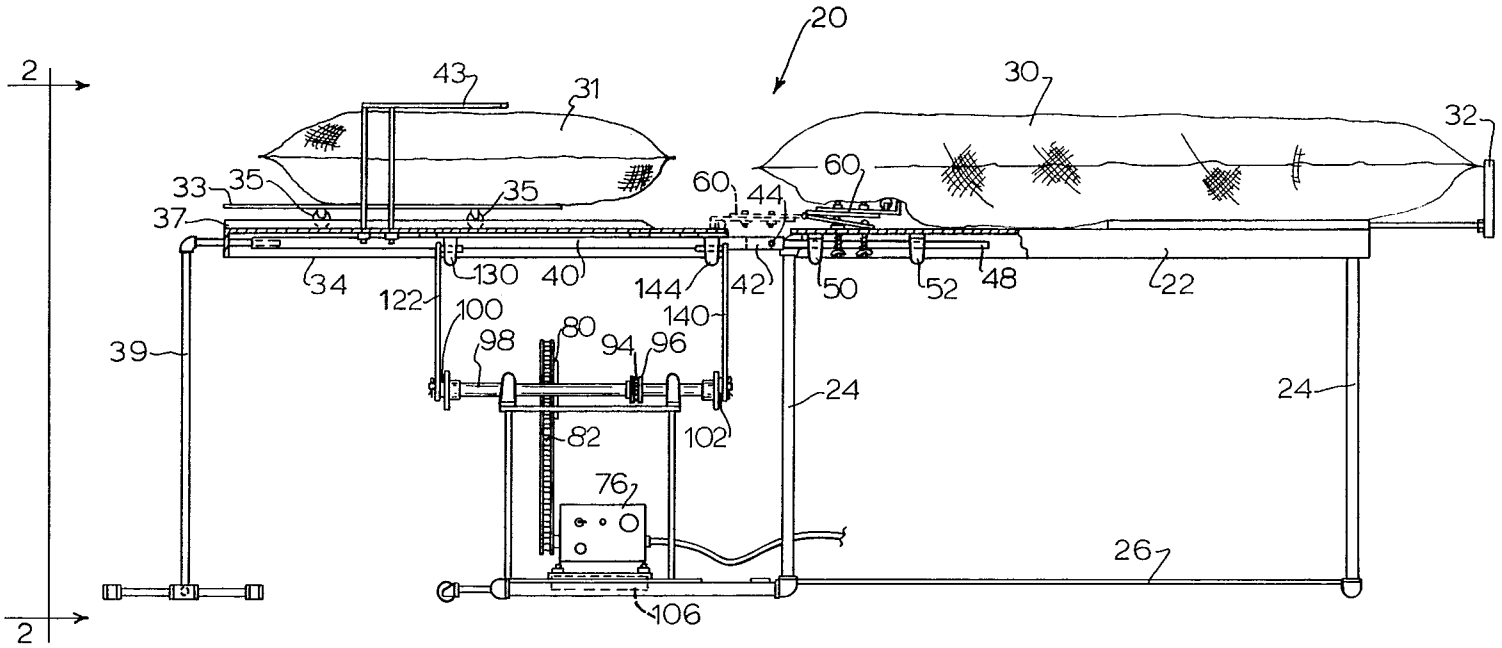
FIG. 1 is a side elevation view of the invention exercising apparatus with the motor drive and linkages in a first mode of operation.

Making reference to the drawings, exercise machine 20 of the invention comprises a fixed table 22 formed of sheet metal or other relatively rigid sheet material, vertical frame supports 24 and a connecting lower brace 26. Fixed table 22 has mounted thereon a suitable cushion 30 and an adjustable foot rest 32. Table 22 is connected to another movable table 34 also formed of sheet metal or comparable rigid sheet material. The connection between fixed table 22 and movable table 34 comprises a shaft 40 fixedly secured beneath table 34 and having a fork 42 which receives a mating shaft portion 46 connected to a circular rod 48 mounted for rotation in bearings 50, 52 supported beneath the fixed table 22. Fork 42 and mating portion 46 are connected together for pivotal movement through pin 44. Thus, movable table 22 is able to both pivot around the axis of shaft 40 which passes through the longitudinal central axis of table 34 or pivot around the horizontal axis passing through pin 44 which is perpendicular to the axis of shaft 40. A hinge mounted cover 60 extending for the width of the movable table 34 provides back support when the movable table is raised, and covers the connection between the fixed table 22 and movable table 34. (See FIGS. 1 and 4).

The drive mechanism 70 (FIG. 3) comprises a variable speed motor 72, gear box 74 and motor control 76. Motor 72 through gear box 74 drives sprocket 80 through connecting chain 82 to rotate the relatively long crank arms 84, 86, each provided with a set of link pin holes 88. Shaft 90, which mounts and drives the relatively long crank arms 84, 86, mounts a sprocket 92 which drives chain 94 connected to drive sprocket 96 on shaft 98 spaced apart from and parallel to shaft 90. Shaft 98 in turn mounts and drives a pair of relatively short crank arms 100, 102 having link pin holes 89. Crank arms 100, 102 are effectively 180° out of phase with relatively long crank arms 84, 86. That is, when relatively long crank arms 84, 86 are up, relatively short crank arms 100, 102 are down. Motor 72 and gear box 74 are mounted on a "Lazy Susan" type platform 106 which can be rotated 90° relative to supporting frame members 108, 110 and releasably locked by screws, or the like, not shown. Thus, drive mechanism 70 can assume either the crosswise position as in FIGS. 1, 2 and 3 or the relatively lengthwise position as in FIGS. 4 and 5.

Figure 5:
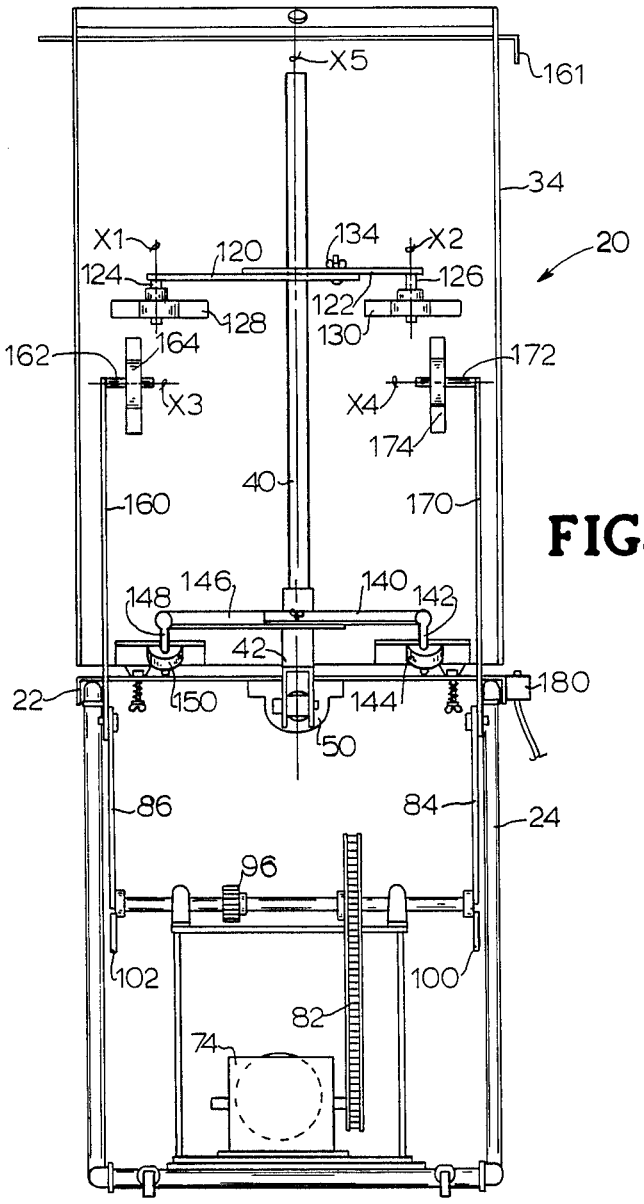
FIG. 5 is an end view taken in the direction of line 5—5 of FIG. 4 illustrating the various linkages in relation to the motor drive and frame structure.
Figure 6:
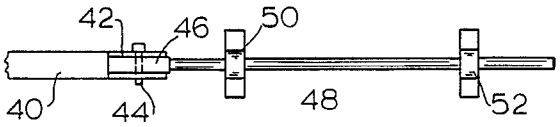
FIG. 6 is a plan view of the elements making up the pivotal and rotatable connection between the fixed and movable tables.

Connections between relatively long crank arms 84, 86 and relatively short crank arms 100, 102 are made through use of linkages which connect respective crank arms to respective bearing connections beneath movable table 34. Such linkages include a pair of relatively short linkages 120, 122 extending from shafts 124, 126 mounted in bearings 128, 130 and shown in an inoperative position in FIG. 5 connected together by a bolt and wing nut fastener 134. Another set of similar short linkages includes linkage 140 mounted on shaft 142 supported in bearing 144 and linkage 146 supported on shaft 148 mounted in the bearing 150. Short linkages 140 and 146 are in a stored position as seen in FIG. 5. Each of the linkages 120,. 122, 140, 146 shown in a stored position in FIG. 5 have a series of link pin holes as illustrated in FIG. 2.

Another set of relatively long linkages comprises linkage 160 mounted on shaft 162 supported in bearing 164. A comparable linkage also seen in FIG. 5 comprises linkage 170 mounted on shaft 172 supported in bearing 174. It will be noted that shafts 124, 126 on the relatively short linkages 120, 122 rotate on laterally spaced parallel axes X1 and X2 which are parallel to the central longitudinal axis X5 of table 34. In contrast, shafts 162 and 172 on the relatively long linkages 160, 170 rotate on axes X3, X4 which are perpendicular to the central longitudinal axis X5 of the movable table 34. Linkages 160, 170 when not in use as in FIG. 1 are held out of position by rod 161.

Figure 7:
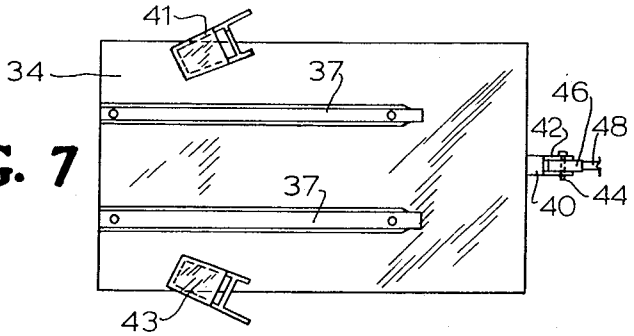
FIG. 7 is a plan view of the rails on top of the movable platform on which a roller-supported table glides back and forth.

Operation of motor 72 is controlled by a suitably located switch 180. During operation cushion 31 mounts on table 33 supported by sets of rollers 35 mounted to travel in a pair of parallel tracks 37 (FIG. 7) secured to the upper surface of table 34. Thus, cushion 31 and the portion of the body supported thereon are able to move relative to table 34 when table 34 is pivoting up and down. A removable support stand 39 provides end support for the mode of operation depicted in FIG. 1.

Figure 3:
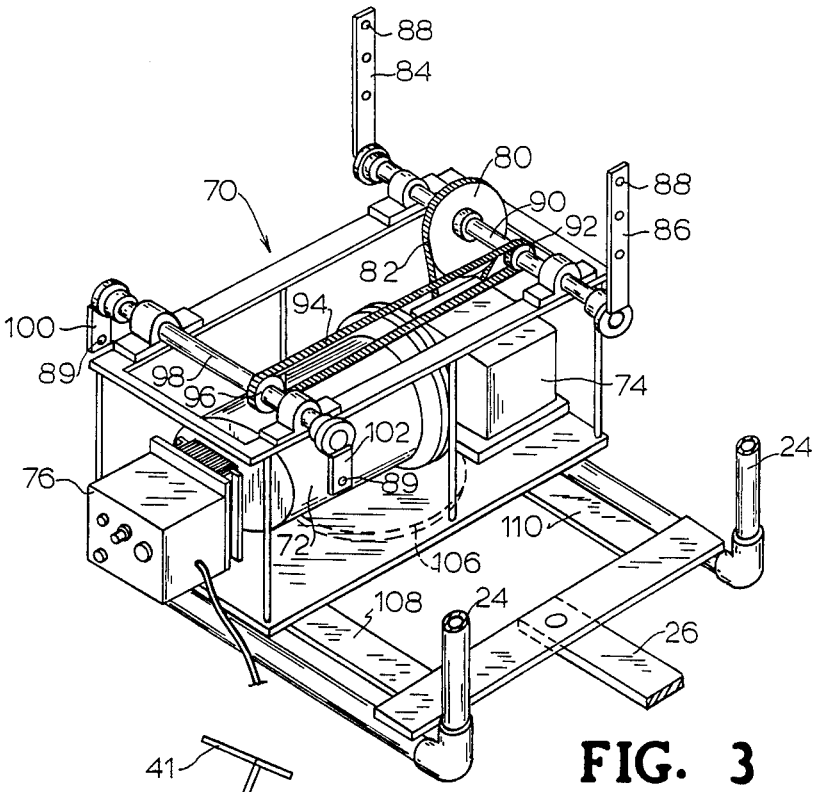
FIG. 3 is a perspective view of the drive mechanism only.
Figure 2:
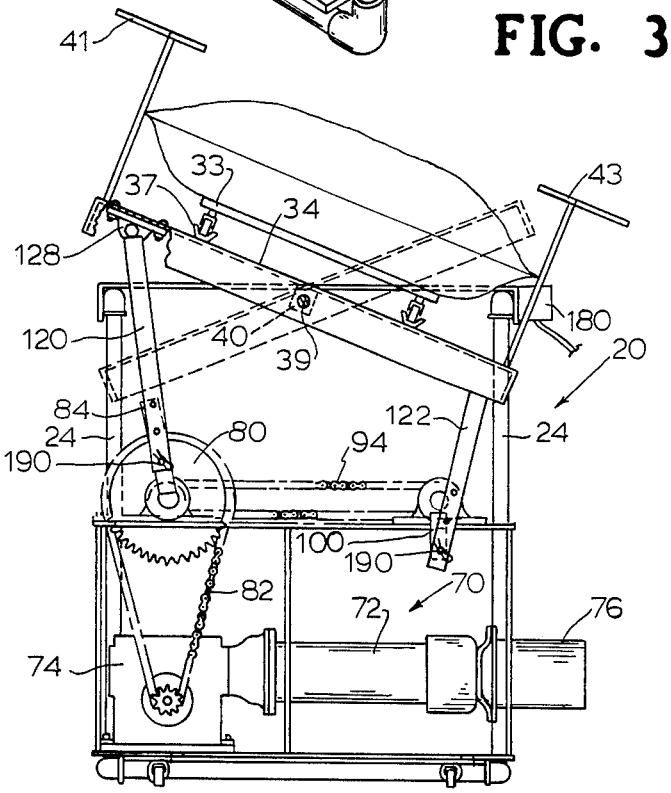
FIG. 2 is an end elevation view taken generally in the direction of line 2—2 of FIG. 1.
Figure 4:
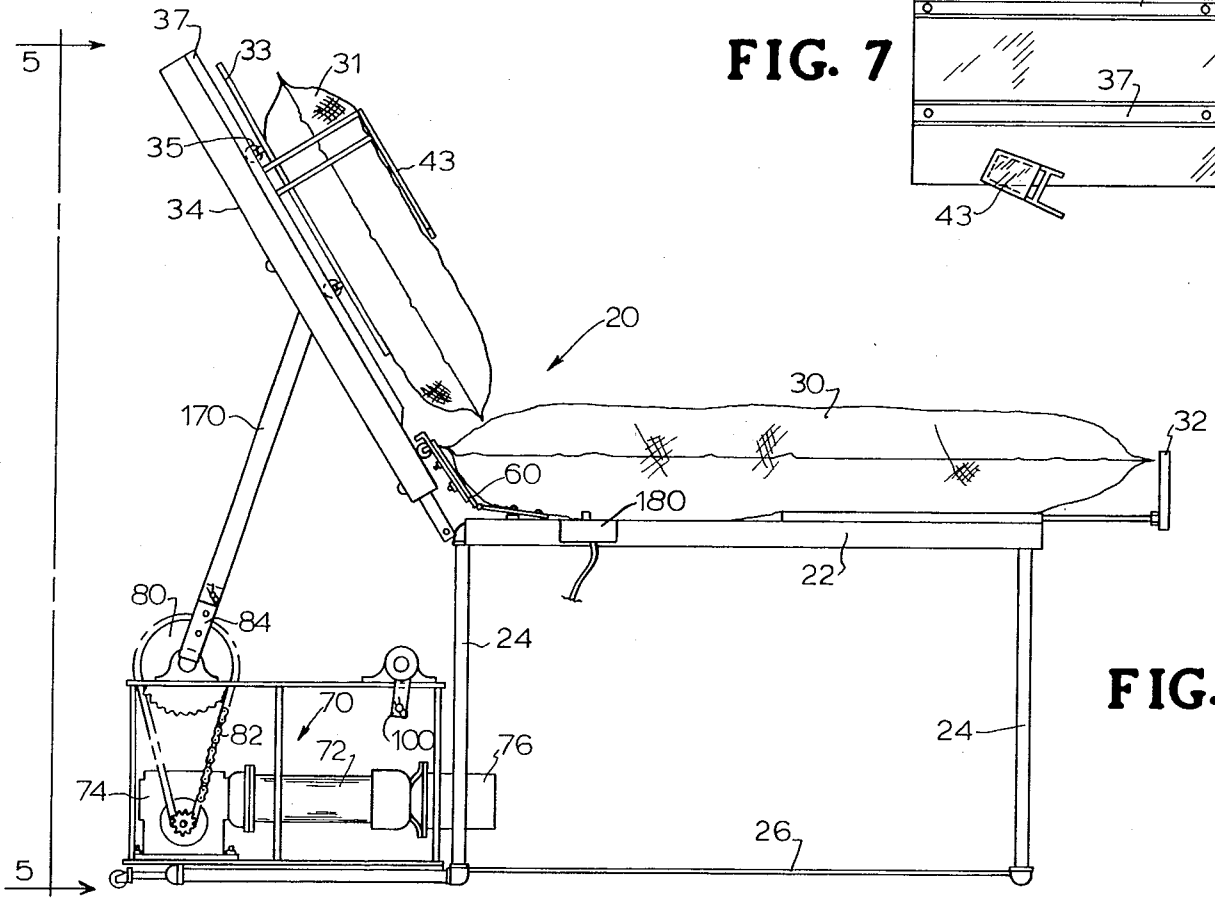
FIG. 4 is a side elevation view illustrating the motor drive and linkage mechanism oriented 90° compared to the orientation in FIGS. 1 and 2 and with the linkages connected for relatively high vertical pivoting only above the horizontal plane.

The passive exercising apparatus of the invention provides a wide variety of exercises which can be varied by locating drive mechanism 70 either in the relatively crosswise position as in FIGS. 1, 2 and 3 or in the relatively lengthwise position as in FIGS. 4 and 5. For example, when drive mechanism 70 is in the relatively crosswise position as in FIGS. 1, 2 and 3 the linkages are connected as seen in FIGS. 1 and 2 which effectively provides a pivoting action of table 34 relative to the fixed table 22 with end support being furnished by stand 39. Thus, the user by placing the upper portion of his body on cushion 31 and the lower portion on cushion 30 can obtain an effective twisting action of the upper portion relative to the lower portion. Alternatively, the user may place the upper portion of his body on cushion 30 and the lower portion on cushion 31 and obtain a relative twisting action of the lower portion relative to the upper portion of the body. The relative position of the linkages on the respective long and short crank arms 84, 86, 100, 102 can be varied by proper choice of the location of the connecting pins 190 (FIG. 2) in the respective holes provided in the various crank arms and linkages. A relatively high pivotal action or relatively low pivotal action can thus be obtained in the mode of operation depicted in FIG. 2 for example.

In the mode of operation depicted in FIGS. 4 and 5 in which the drive mechanism 70 is in a relatively lengthwise position, only the relatively long linkages 160, 170 are employed and the relatively short linkages 120, 122, 140, 146 are stored as in FIG. 5. In one form of passive exercise as best seen in FIG. 4, the respective long linkages 160, 170 are mounted in their extreme positions on the relatively long crank arms 84, 86 thus providing a maximum amount of upward tilting of movable platform 34 as seen in FIG. 4. The user can employ this mode of operation either by placing the upper part of his body on the cushion 31 and the lower portion of his body on cushion 30 or alternatively by placing the lower portion of the body on cushion 31 and the upper portion on cushion 30. In either event as table 34 moves up and down cushion 31 moves back and forth relative to table 34 by means of table 33 gliding on rails 37 through the support provided by rollers 35. When the user supports the upper portion of his body on cushion 30 his feet can be supported in the combination foot and hand rests 41, 43 so as to effectively obtain a knee bending action. By appropriate adjustment of the linkages on the crank arms, the movable platform 34 can be caused to move above or below the horizontal plane and effect corresponding relatively small or relatively large bends of the body portions being exercised.

A twisting action of table 34 is readily obtained in the mode of operation as seen in FIG. 4 by adjusting the respective relatively long linkages 160, 170 in different positions on the respective relatively long crank arms 84, 86. Thus, a combined vertical up and down pivoting action with a twisting type action is readily obtainable.

In summary, it can be seen that a substantially improved passive exercising apparatus has been provided in which any of a variety of pivotal, twisting or combined pivotal and twisting motions can be obtained. Thus, the invention apparatus, unlike the prior art apparatus adapts to a substantially wide range of exercising conditions, up and down pivoting with no twisting above or below the fixed platform, up and down pivoting with twisting above or below the fixed platform, a straight sit-up-type exercise or a sit-up-type exercise in which the person's head is on the fixed platform and the hands grasp the hand holds 41, 43 or, alternatively, the feet are supported on the linkages for relatively small pivoting with no twisting either above or below the horizontal plane, further variation can be obtained by lying either face down or face up.

What is claimed is:

1. A passive exercising apparatus comprising:

(a) a first stationary horizontal platform supported on a frame and adapted to support as desired either a user's upper or lower body portions in a relatively fixed position;

(b) a second platform forming a lengthwise extension of said first platform and connected thereto by means enabling said second platform to pivot about a first axis between said platforms and perpendicular to the central longitudinal axis of said second platform, pivot about a second axis comprising the central longitudinal axis of said second platform or simultaneously pivot about both said axes;

(c) a drive mechanism having:

(i) a first pair of laterally spaced relatively short crank arms mounted on the end of a first horizontal drive shaft;

(ii) a second pair of laterally spaced relatively long crank arms mounted on the end of a second horizontal drive shaft located parallel to and spaced apart from first drive shaft;

(iii) means to drive said first and second pair of crank arms with one pair of crank arms leading the other by substantially 180° of rotation;

(iv) a first pair of laterally spaced relatively long linkages extending in a plane parallel to said second axis, each said long linkage being pivotally connected at one end to the underside of said second platform and at the opposite end each said long linkage being adjustably connectable to one of said relatively long crank arms dependent on said drive shafts being oriented substantially parallel to the said second axis;

(v) third and fourth pairs of laterally spaced relatively short linkages extending in a plane parallel to said first axis, each said relatively short linkage being pivotally connected at one end to the underside of said second platform and at the opposite end being adjustably connectable to one of said relatively short crank arms dependent on said drive shafts being oriented substantially perpendicular to the said second axis; and (vi) means rotatably mounting said drive means enabling said drive shafts to be selectively oriented to reside either parallel or perpendicular to the said second axis;

wherein when said drive shafts are oriented perpendicular to said second axis, said second platform is able to pivot about said second axis and when said drive shafts are oriented parallel to said second axis, said second platform is able to selectively pivot up and down about said first axis alternatively both pivot up and down about said first axis while simultaneously pivoting about the said second axis.

2. A passive exercising apparatus as claimed in claim 1 wherein said means to drive said first and second pair of crank arms comprises a variable speed motor.

3. A passive exercising apparatus as claimed in claim 1 wherein said drive shafts are positioned at the same vertical level above the base of said frame.

4. A passive exercising apparatus as claimed in claim 1 including:

(a) first and second cushions mounted respectively on said first and second platforms; and (b) an auxiliary platform mounted for lengthwise movement along said second platform and adapted to support said second cushion.

5. A passive exercising apparatus as claimed in claim 1 including on opposite sides of said second platform means enabling the user to support his feet or secure his hands at a level spaced outwardly from said second platform during selected exercises performed with said apparatus.

* * * * *

UNITED STATES PATENT AND TRADEMARK OFFICE

CERTIFICATE OF CORRECTION

PATENT NO. : 4,723,537

DATED : February 9, 1988

INVENTOR(S) : Alonzo E. Parker

It is certified that error appears in the above-identified patent and that said Letters Patent is hereby corrected as shown below:

Column 6, line 8, insert "or" after --axis--.

Signed and Sealed this

Sixth Day of September, 1988

*Attest:*

DONALD J. QUIGG

*Attesting Officer*

*Commissioner of Patents and Trademarks*